US010344367B2

(12) United States Patent
Narita et al.

(10) Patent No.: US 10,344,367 B2
(45) Date of Patent: Jul. 9, 2019

(54) METHOD FOR PRODUCING NI-BASED SUPERALLOY MATERIAL

(71) Applicant: DAIDO STEEL CO., LTD., Nagoya-shi (JP)

(72) Inventors: Shuji Narita, Nagoya (JP); Kohki Izumi, Nagoya (JP); Kenta Yamashita, Shibukawa (JP); Shigeki Ueta, Nagoya (JP)

(73) Assignee: DAIDO STEEL CO., LTD., Nagoya-Shi, Aichi (JP)

( * ) Notice: Subject to any disclaimer, the term of this patent is extended or adjusted under 35 U.S.C. 154(b) by 86 days.

(21) Appl. No.: 15/708,611

(22) Filed: Sep. 19, 2017

(65) Prior Publication Data

US 2018/0148818 A1 May 31, 2018

(30) Foreign Application Priority Data

Nov. 28, 2016 (JP) ..... 2016-230364

(51) Int. Cl.

| | |
|---|---|
| ***C22F 1/10*** | (2006.01) |
| ***B21J 5/06*** | (2006.01) |
| ***C22C 19/05*** | (2006.01) |
| ***C22C 30/00*** | (2006.01) |

(52) U.S. Cl.
CPC ..... *C22F 1/10* (2013.01); *B21J 5/06* (2013.01); *C22C 19/056* (2013.01); *C22C 30/00* (2013.01)

(58) Field of Classification Search
CPC ..... C22F 1/10; C22C 19/056
See application file for complete search history.

(56) References Cited

U.S. PATENT DOCUMENTS

| | | | |
|---|---|---|---|
| 4,574,015 | A | 3/1986 | Genereux et al. |
| 4,769,087 | A | 9/1988 | Genereux et al. |
| 4,957,567 | A | 9/1990 | Krueger et al. |
| 5,120,373 | A | 6/1992 | Miller et al. |
| 6,059,904 | A | 5/2000 | Benz et al. |
| 6,521,175 | B1 | 2/2003 | Mourer et al. |
| 2009/0000706 | A1 | 1/2009 | Huron et al. |
| 2012/0006452 | A1 | 1/2012 | Mitchell et al. |
| 2015/0284823 | A1 | 10/2015 | Osaki et al. |
| 2015/0368774 | A1 | 12/2015 | Ota et al. |

FOREIGN PATENT DOCUMENTS

| | | | |
|---|---|---|---|
| CN | 104278175 | A | 1/2015 |
| EP | 2 019 150 | A1 | 1/2009 |
| EP | 2 826 877 | A2 | 1/2015 |
| EP | 2 963 135 | A1 | 1/2016 |
| JP | H 05-508194 | A | 11/1993 |
| JP | H 09-310162 | A | 12/1997 |
| JP | 2016-003374 | A | 1/2016 |
| WO | WO 92/018660 | A1 | 10/1992 |

OTHER PUBLICATIONS

Canadian Office Action, dated Nov. 6, 2018, in corresponding Canadian Patent Application No. 2,980,063.
Canadian Office Action, dated Nov. 6, 2018, in corresponding Canadian Patent Application No. 2,980,052 of the related U.S. Appl. No. 15/708,594.
Autstralian Office Action, dated Oct. 16, 2018, in Australian Application No. 2017232117.
Extended European Search Report dated Apr. 10, 2018 in corresponding European Patent Application No. 17192801.3.
Chinese Office Action, dated Apr. 23, 2019, in Chinese Application No. 201711214221.9 and English Translation thereof.

*Primary Examiner* — Jessee R Roe
(74) *Attorney, Agent, or Firm* — McGinn IP Law Group, PLLC.

(57) ABSTRACT

The present invention relates to a method for producing a precipitation strengthened Ni-based superalloy material having a predetermined composition, containing a blooming forging step of performing a forging at a temperature range of from Ts to Tm and performing an air cooling to form a billet having an average crystal grain size of #1 or more, an overaging thermal treatment step of heating and holding the billet at a temperature range of from Ts to Ts+50° C. and slowly cooling it to a temperature of Ts or lower, and a crystal grain fining forging step of performing another forging at a temperature range of from Ts−150° C. to Ts and performing another air cooling, in which Ts is from 1,030° C. to 1,100° C., and an overall average crystal grain size is #8 or more after the crystal grain fining forging step.

8 Claims, 1 Drawing Sheet

METHOD FOR PRODUCING NI-BASED SUPERALLOY MATERIAL

TECHNICAL FIELD

The present invention relates to a method for producing a γ'-precipitation strengthened Ni-based superalloy material. Particularly, it relates to a method for producing an Ni-based superalloy material, which method can afford fine crystal grains over the whole even in the case where the material is a large-sized alloy material and can impart high mechanical strength.

BACKGROUND ART

There is known a precipitation strengthened Ni-based superalloy in which fine precipitates composed of an intermetallic compound are dispersed in an Ni matrix. Such an alloy has been widely used as parts that require mechanical strength under high temperature environment, for example, parts for a gas turbine or a steam turbine. As a representative alloy, there may be mentioned a γ'-precipitation strengthened Ni-based superalloy which contains Ti and Al forming intermetallic compounds with Ni and in which γ'-phase of the intermetallic compound is finely dispersed in a γ-phase that is an Ni matrix. However, in such an alloy, when the γ' phase is excessively precipitated, hot workability decreases and crystal grains cannot be fined by forging, so that good mechanical strength cannot be obtained.

For example, Patent Document 1 discloses a method for producing an Ni-based superalloy material in which γ' grains are coarsened by overaging to secure hot workability and fining of crystal grains is attained at a forging step, in a γ'-precipitation strengthened Ni-based superalloy containing an increased amount of the γ'-phase as compared with an alloy that is referred to as Waspaloy. In this method, an alloy lump is heated to a temperature higher than the solvus temperature Ts to form a solid solution of the γ'-phase and then, it is slowly cooled to allow the γ'-phase to precipitate and grow to form an overaged structure. Subsequently, forging and rotary forging are further performed at a temperature lower than Ts, thereby obtaining fine crystal grains of ASTM 12 or more. In this method, the solvus temperature is set to be from 1,110 to 1,121.1° C., which is higher than that of a common same-type alloy species. This is because the forging temperature can be raised and forging resistance can be lowered even when the forging is performed at a temperature of Ts or lower without forming a solid solution of the γ' grains.

Moreover. Patent Document 2 discloses a method for producing a precipitation strengthened Ni-based superalloy material that may contain a large amount of the γ'-phase. In this method, an ingot is held at a temperature of the solvus temperature Ts or lower to allow a part of the γ'-phase to form solid solution, and then slowly cooled, thereby transforming the γ'-grains into coarse grains having an average particle size of 1.5 μm or more by overaging, thereby securing hot workability. Subsequently, the alloy structure is fined by extrusion processing while promoting recrystallization. It is said that voids generated on this occasion are eliminated by subsequent HIP treatment.

In addition, Patent Document 3 discloses a method for producing an Ni-based superalloy material in which a hot-forged material is subjected to slow cooling overaging and forging at a predetermined temperature of the solvus temperature Ts or lower to obtain a disconformable γ' phase which does not have continuity to the crystal lattice of the γ-phase that is a matrix and does not have a large influence on mechanical strength, thereby securing hot workability. After sizing by forging, a solution treatment is performed to transfer the disconformable γ' phase into a solid solution again and a conformable γ'-phase is then precipitated by performing an aging treatment.

Patent Document 1: JP-T-H05-508194
Patent Document 2: JP-A-H09-310162
Patent Document 3: JP-A-2016-3374

SUMMARY OF THE INVENTION

Incidentally, in a method for producing a γ'-precipitation strengthened Ni-based superalloy material, when the material size to be produced is intended to increase, unevenness is prone to occur by fining of crystal grains through forging alone and thus it is preferable to suppress the coarsening itself of the crystal grains during the production process.

The present invention was made in consideration of such circumstances, and an object thereof is to provide a method for producing a γ'-precipitation strengthened Ni-based superalloy material, which method can afford a fine alloy structure even when the material size becomes large.

The method for producing an Ni-based superalloy material according to the present invention is a method for producing a precipitation strengthened Ni-based superalloy material having a component composition consisting of, in terms of % by mass:

C: more than 0.001% and less than 0.100%,
Cr: 11% or more and less than 19%,
Co: more than 5% and less than 25%,
Fe: 0.1% or more and less than 4.0%,
Mo: more than 2.0% and less than 5.0%,
W: more than 1.0% and less than 5.0%,
Nb: 0.3% or more and less than 4.0%,
Al: more than 3.0% and less than 5.0%,
Ti: more than 1.0% and less than 2.5%, and
Ta: 0.01% or more and less than 2.0%, and
optionally,
B: less than 0.03%,
Zr: less than 0.1%,
Mg: less than 0.030%,
Ca: less than 0.030%, and
REM: 0.200% or less,
with the balance being unavoidable impurities and Ni, in which, when a content of an element M in terms of atomic % is represented by [M], a value of ([Ti]+[Nb]+[Ta])/[Al]×10 that serves as an index of a solid solution temperature of a γ' phase is 3.5 or more and less than 6.5, and a value of [Al]+[Ti]+[Nb]+[Ta] that serves as an index of a production amount of the γ' phase is 9.5 or more and less than 13.0, the method containing:

a blooming forging step of performing a forging at a temperature range of from a solvus temperature Ts that is a solid solution temperature of the γ' phase to a melting point Tm and performing an air cooling to form a billet having an average crystal grain size of #1 or more, an overaging thermal treatment step of heating and holding the billet at a temperature range of from Ts to Ts+50° C. and then slowly cooling it to a temperature Ts' that is Ts or lower so that γ'-phase grains are allowed to precipitate and grow and to increase an average interval thereof, and a crystal grain fining forging step of performing another forging at a temperature range of from Ts−150° C. to Ts and performing another air cooling, in which Ts is from 1,030° C. to 1,100° C., and in which crystal growth is suppressed by the γ'-phase grains resulting from the overaging thermal treatment to result in an overall average crystal grain size of #8 or more after the crystal grain fining forging step.

According to the present invention, the solvus temperature is controlled to be relatively low to afford the γ'-phase grains having a large average interval. Therefore, coarsening of the crystal grains is suppressed without lowering hot workability and as a result, even in the case of a large-sized material, an alloy structure having a fine grain size of #8 or more can be afforded over the whole material.

In the above-described invention, the average interval of the γ'-phase grains after the overaging thermal treatment may be 0.5 μm or more. According to this aspect, the coarsening of the crystal grains can be more surely suppressed without lowering the hot workability.

In the above-described invention, in the overaging thermal treatment step, a cooling rate to Ts' may be 20° C./h or less and Ts' may be less than Ts−50. According to this aspect, a γ' phase having a large average interval can be easily obtained and the coarsening of the crystal grains can be more surely suppressed without lowering the hot workability.

In the above-described invention, the component composition may contain, in terms of % by mass, at least one element selected from the group consisting of:

B: 0.0001% or more and less than 0.03% and

Zr: 0.0001% or more and less than 0.1%.

According to this aspect, high-temperature strength of a final product can be enhanced without lowering the hot workability.

In the above-described invention, the component composition may contain, in terms of % by mass, at least one element selected from the group consisting of:

Mg: 0.0001% or more and less than 0.030%,

Ca: 0.0001% or more and less than 0.030% and

REM: 0.001% or more and 0.200% or less.

According to this aspect, the high-temperature strength of a final product can be enhanced and also a decrease in the hot workability can be more suppressed.

MODES FOR CARRYING OUT THE INVENTION

A method for producing an Ni-based superalloy material according to one example of the present invention will be described with reference to FIG. 1 and FIG. 2.

Figure 1:
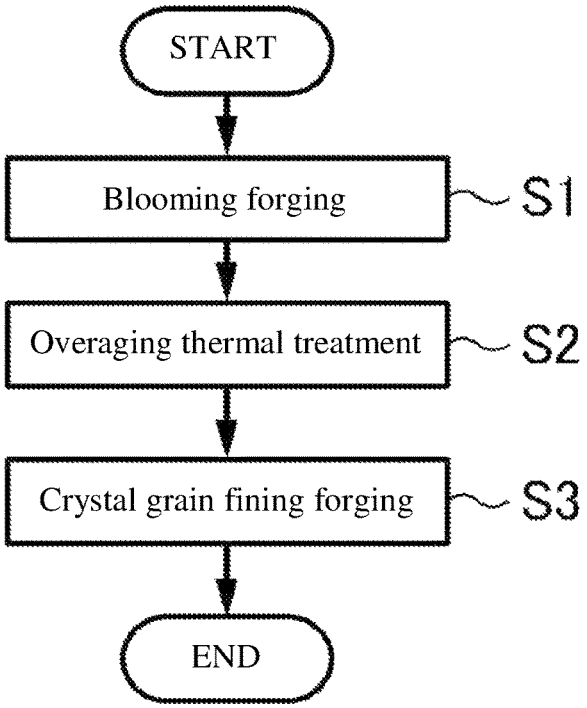
FIG. 1 is a flow chart showing steps of the method for producing an Ni-based superalloy material according to the present invention.
Figure 2:
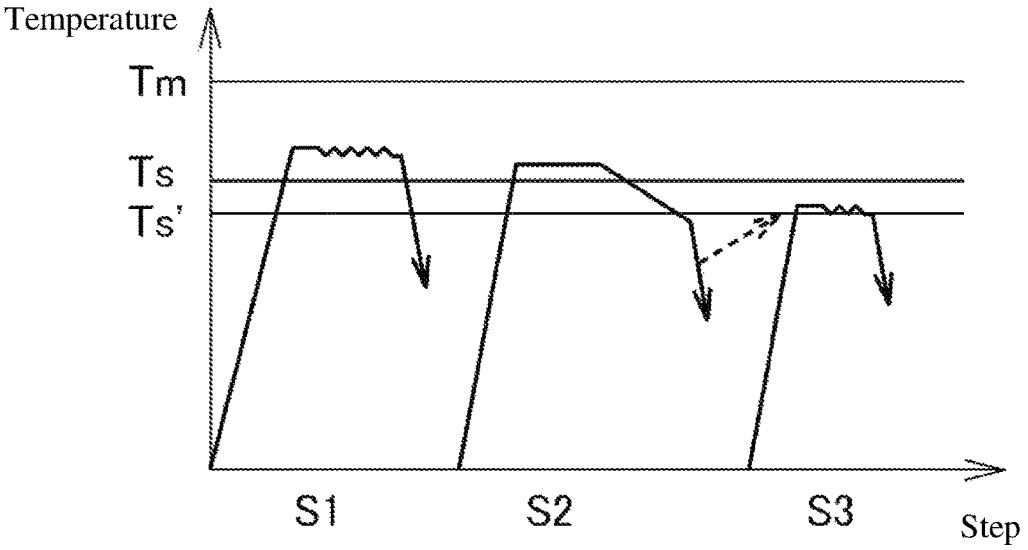
FIG. 2 is a thermal treatment diagram of each step of the method for producing an Ni-based superalloy material according to the present invention.

As shown in FIG. 1 and FIG. 2, first, a blooming forging is performed (S1). In the blooming forging step S1, an ingot of an alloy having a predetermined component composition is subjected to blooming forging at a temperature range of from the solvus temperature Ts that is the solid solution temperature of the γ' phase to the melting point Tm and air-cooled, thereby controlling the crystal grain size of the alloy structure to #1 or more as the grain size number specified in JIS G0551: 2013. In the blooming forging step S1, it is important to obtain a billet homogeneous as a whole as possible so that the γ' phase is made to be precipitated in the entire region of the billet in the overaging thermal treatment to be described later. Therefor, in the blooming forging step S1, it is preferred to control a forging ratio to 1.5S or more. Incidentally, blooming may be not necessary depending on the size of the billet but the forging in such a case is herein also referred to as a "blooming forging step". Moreover, it is also preferable to perform a homogenization thermal treatment before the blooming forging step S1.

The above-described predetermined component composition is a component composition of a γ'-precipitation strengthened Ni-based superalloy, which composition consists of, in terms of % by mass:

C: more than 0.001% and less than 0.100%,

Cr: 11% or more and less than 19%.

Co: more than 5% and less than 25%,

Fe: 0.1% or more and less than 4.0%,

Mo: more than 2.0% and less than 5.0%.

W: more than 1.0% and less than 5.0%,

Nb: 0.3% or more and less than 4.0%,

Al: more than 3.0% and less than 5.0%.

Ti: more than 1.0% and less than 2.5%, and

Ta: 0.01% or more and less than 2.0%, and optionally,

B: less than 0.03%,

Zr: less than 0.1%.

Mg: less than 0.030%,

Ca: less than 0.030%, and

REM: 0.200% or less, with the balance being unavoidable impurities and Ni.

Furthermore, when a content of an element M in terms of atomic % is represented by [M], a value of ([Ti]+[Nb]+[Ta])/[Al]×10 is 3.5 or more and less than 6.5, and a value of [Al]+[Ti]+[Nb]+[Ta] is 9.5 or more and less than 13.0.

The above-described two expressions are explained:

$$[Al]+[Ti]+[Nb]+[Ta]; \text{ and} \qquad \text{Expression 1:}$$

$$([Ti]+[Nb]+[Ta])/[Al]\times 10. \qquad \text{Expression 2:}$$

Expression 1 represents a total content of the elements that form the γ' phase. That is, Expression 1 serves as an index of increasing the precipitation amount of the γ' phase in a temperature region lower than the solid solution temperature of the γ' phase, in other words, one index for enhancing the high-temperature strength of a forged product to be obtained. As for the value of Expression 1, the lower limit as described above is set for securing the high-temperature strength. Also, the upper limit as described above is set for securing the hot forgeability. Expression 2 mainly serves as one index of a level of the solvus temperature. That is, there is a tendency that the solvus temperature Ts is raised as the contents of Ti, Nb and Ta increase and is lowered as the content of Al increases. As for the value of Expression 2, the above-described upper limit is set so as to relatively lower the solvus temperature Ts and the above-described lower limit value is set for securing the high-temperature strength of a product to be obtained.

In addition, the above-described predetermined component composition is controlled so that the solvus temperature Ts is from 1,030° C. to 1,100° C. For example, it is possible that the solvus temperature is measured beforehand by a thermal analysis or the like to confirm that the temperature falls within the above-described range. In the case where the solvus temperature Ts is relatively low, an interval from the solvus temperature Ts to the melting point Tm becomes wide, so that the hot forging at a temperature higher than the solvus temperature Ts, that is, the blooming forging S1 becomes easy. Thereby, the fining of the structure by the forging can be facilitated and the above-described alloy structure having a grain number (in an average crystal grain size) of #1 or more can be obtained.

The billet after the blooming forging is subjected to the overaging thermal treatment (S2). In the overaging thermal treatment S2, the billet is heated and held at a temperature range of the solvus temperature Ts or higher and Ts+50° C. or lower and then, slowly cooled to a temperature Ts' that is Ts or lower. Although it depends on the size of the billet, the holding time is preferably 0.5 hours or more for soaking to the inside. Moreover, in the slow cooling, the cooling rate is set so that the precipitating γ' phase is allowed to grow to increase the average interval among the grains of the γ' phase. The average interval among the grains of the γ' phase is preferably 0.5 μm or more. In addition, therefor, the cooling rate at the slow cooling is preferably 20° C./h or less. From the viewpoints of production efficiency, cost, and the like, a lower limit of the cooling rate is preferably 5° C./h so that the slow cooling takes not so much time. Incidentally, the amount of the precipitating γ' phase does not increase even when the cooling rate is more decreased. Furthermore, in the case where the temperature Ts' is controlled to lower than Ts−50° C., the γ' phase can be surely allowed to precipitate and grow, so that the case is preferable. After the slow cooling, an air cooling may be performed, but instead, heating may be subsequently performed without air cooling, to continue to the next crystal grain fining forging step.

Subsequently, the overaged billet is subjected to another forging at a temperature of the solvus temperature Ts or lower and Ts−150° C. or higher so as to achieve fining of the crystal grains of the alloy structure (crystal grain fining forging step S3). As described above, since the average interval among the grains of the γ' phase becomes as wide as 0.5 μm or more, the γ' phase hardly influences migration of dislocation and thus hot deformation resistance can be decreased. Therefore, the hot workability becomes high and, in the crystal grain fining forging step S3, a strain for promoting recrystallization of the alloy structure to the inside of the billet can be imparted, so that a fine alloy structure can be wholly attained. Here, the forging ratio including the blooming forging step S1 is preferably controlled to 2.0S or more. Moreover, when the average interval among the grains of the γ' phase is widened, the average grain size of grains of the γ' phase becomes also large and thus coarsening of the crystal grains can be suppressed with inhibiting the migration of a crystal grain boundary. Due to such a crystal grain fining forging, an alloy structure having a grain size (an average crystal grain size) of grain number #8 specified in JIS G0551: 2013 or more can be wholly obtained.

Accordingly, a γ'-precipitation strengthened Ni-based superalloy material can be obtained. To such an alloy material, mechanical strength, particularly high-temperature mechanical strength required as parts is imparted through further shaping processing such as die forging or mechanical processing, by forming a solid solution of coarse γ' phase by a solid solution thermal treatment and by finely precipitating the γ' phase by an aging treatment. These steps are known and hence details are omitted.

According to the above-described method for producing a γ'-precipitation strengthened Ni-based superalloy material, an alloy material with a fine alloy structure wholly having an average crystal grain size of #8 or more can be obtained. Since the solvus temperature Ts of the alloys to be used in this example is relatively low, the set temperature of the whole process can be made relatively low and it is easy to maintain the fine alloy structure. That is, coarsening of the crystal grains itself can be suppressed all over the production process and thus, even when the size of the material is, for example, one as in a large-sized billet having a diameter of 10 inches or more, fining of the crystal grains is possible without relying on only fining of the crystal grains by forging.

EXAMPLE

The following will explain the results of trial production of alloy materials by the above-described production method.

Table 1 shows component compositions of the Ni-based superalloys used for the trial production. Moreover, Table 2 shows values of Expressions 1 and 2 indicating the relations of the constituent elements of the γ' phase and the solvus temperature of each of these alloys. Furthermore, Table 3 shows a part of the production conditions of individual production steps and evaluation on the alloy structure in each production step.

The following will explain the production conditions of the trial production and evaluation results thereof.

First, each of molten alloys having component compositions shown in Table 1 was produced by using a high frequency induction furnace to prepare a 50 kg ingot having a diameter of 130 mm. The obtained ingot was subjected to a homogenization thermal treatment of holding it at 1,180° C. for 16 hours. Then, test materials for Examples 1 to 7 and Comparative Examples 1 to 5 were produced by using the respective alloys designated by the composition number under the respective production conditions shown in Table 3.

Specifically, in the blooming forging step S1, a billet having a diameter of 100 mm was obtained at a forging ratio of 1.7 at a forging temperature of 1.180° C. or 1,140° C. that is a temperature of from the solvus temperature Ts to the melting point Tm. Incidentally, only in Comparative Example 5, the blooming forging step S1 is omitted. Here, a sample for microscopic observation was cut out from a part of each test material and the crystal grain size was measured and evaluated. Cases where the crystal grain size was #1 or more were evaluated as good and the other cases were evaluated as bad, with recording "A" and "C" in the column of "Crystal grain size A" in Table 3, respectively.

In the overaging thermal treatment step S2, the test material was held for 1 hour at a holding temperature that is a temperature of the solvus temperature Ts plus a numerical value shown in each column of "Holding temperature" in Table 3. Thereafter, the test material was slowly cooled to 950° C. that is a temperature lower than Ts−50° C. at a rate shown in the column of "Slow cooling rate" in Table 3, and air-cooled. Also here, a sample for microscopic observation was cut out from a part of the test material and the average interval among the grains of the γ' phase was measured and evaluated. Here, cases where the average interval was 0.5 μm or more were evaluated as good and the other cases were evaluated as bad, with recording "A" and "C" in the column of "Average γ' interval" in Table 3, respectively.

In the crystal grain fining forging step S3, the test material was subjected to another forging at a forging temperature of 1,030° C. or 1,060° C. that is a temperature within a temperature range of from Ts−150° C. to Ts so that a total forging ratio from the ingot size became 4.7, and forgeability was evaluated. Furthermore, a sample for microscopic observation was cut out from the test material having a diameter of 60 mm obtained by such forging, and the crystal grain size was measured and evaluated. For forgeability, cases where no crack and/or flaw were generated were evaluated as good, cases where slight crack and/or flaw were generated were evaluated as moderate and cases where crack(s) were generated were evaluated as bad, with recording "A", "B" and "C" in the column of "Hot workability" in Table 3, respectively. In addition, cases where the crystal grain size is #8 or more were evaluated as good and the other cases were evaluated as bad, with recording "A" and "C" in the column of "Crystal grain size B" in Table 3, respectively.

TABLE 1

| | Component composition (% by mass) | | | | | | | | | | | | | |
|---|---|---|---|---|---|---|---|---|---|---|---|---|---|---|
| | C | Ni | Fe | Co | Cr | W | Mo | Ta | Nb | Al | Ti | Zr | B | Mg |
| Composition 1 | 0.01 | 5.44 | 2.0 | 16.5 | 13.9 | 2.2 | 3.2 | 1.0 | 1.7 | 3.5 | 1.6 | — | — | — |
| Composition 2 | 0.02 | 51.2 | 1.8 | 18.2 | 16.0 | 1.3 | 4.0 | 0.4 | 1.8 | 3.4 | 1.9 | — | — | — |
| Composition 3 | 0.02 | 50.9 | 0.6 | 18.4 | 16.4 | 1.6 | 3.7 | 0.6 | 2.7 | 3.3 | 1.7 | 0.040 | 0.013 | 0.0007 |

TABLE 2

| | Value of Expression 1 | Value of Expression 2 | Solvus temperature Ts (° C.) |
|---|---|---|---|
| Composition 1 | 11.0 | 4.4 | 1,085 |
| Composition 2 | 10.8 | 4.9 | 1,090 |
| Composition 3 | 11.1 | 5.5 | 1,081 |

TABLE 3

| | | Blooming forging | | Overaging thermal treatment | | | Crystal grain fining forging | | |
|---|---|---|---|---|---|---|---|---|---|
| | Composition number | Forging temperature (° C.) | Crystal grain size A | Holding temperature (° C.) | Slow cooling rate (° C./h) | Average γ' interval | Forging temperature (° C.) | Hot work-ability | Crystal grain size B |
| Ex. 1 | 1 | 1,180 | A | 10 | 10 | A | 1,030 | A | A |
| Ex. 2 | 1 | 1,180 | A | 20 | 10 | A | 1,030 | A | A |
| Ex. 3 | 2 | 1,180 | A | 10 | 15 | A | 1,030 | A | A |
| Ex. 4 | 2 | 1,140 | A | 10 | 5 | A | 1,030 | A | A |
| Ex. 5 | 3 | 1,140 | A | 10 | 5 | A | 1,030 | A | A |
| Ex. 6 | 1 | 1,140 | A | 30 | 15 | A | 1,060 | B | A |
| Ex. 7 | 2 | 1,140 | A | 30 | 15 | A | 1,060 | B | A |
| Comp. Ex. 1 | 1 | 1,180 | A | 80 | 10 | C | 1,030 | C | C |
| Comp. Ex. 2 | 1 | 1,180 | A | 10 | 50 | C | 1,030 | B | C |
| Comp. Ex. 3 | 2 | 1,180 | A | −10 | 10 | C | 1,030 | B | C |
| Comp. Ex. 4 | 2 | 1,180 | A | −10 | 50 | C | 1,030 | B | C |
| Comp. Ex. 5 | 2 | — | C | 10 | 10 | C | 1,030 | C | C |

Holding temperature is based on Solvus temperature.

As shown in Table 3, as for Examples 1 to 7, "Crystal grain size A", "Average γ' interval", "Hot workability", and "Crystal grain size B" were all good except that "Hot workability" in Examples 6 and 7 were moderate.

In Comparative Example 1, the holding temperature was as high as Ts+80° C. in the overaging thermal treatment step S2 and, as a result, the case was evaluated as bad for "Average γ' interval", "Hot workability" and "Crystal grain size B". It is considered that this is because the holding temperature was excessively high beyond Ts+50° C. and hence most of the grains of the γ' phase precipitated by cooling after the blooming forging step S1 were allowed to form a solid solution during the holding in the overaging thermal treatment step S2, a large number of precipitation nuclei of the γ' phase were formed during slow cooling, and thus coarse γ' grains were not obtained. Therefore, it is also considered that the γ' phase was finely dispersed, the average interval thereamong was narrowed, the migration of dislocation was inhibited, and thus the hot workability was lowered. Also, it is considered that such coarse γ'-phase grains that prevent the migration of a grain boundary were not sufficiently obtained, the crystal grains were easily allowed to grow in the crystal grain fining forging step S3, and hence a fine alloy structure could not be obtained.

In Comparative Example 2, the cooling rate was as high as 50° C./h in the overaging thermal treatment step S2 and, as a result, the case was evaluated as bad for "Average γ' interval" and "Crystal grain size B". It is considered that this is because a large number of precipitation nuclei of γ' phase were formed during the cooling in the overaging thermal treatment step S2 and thus the grains of the γ' phase could not be sufficiently allowed to grow. Therefore, it is also considered that the γ' phase is finely dispersed, the average interval thereamong is narrowed, the migration of dislocation is inhibited, and thus the hot workability is lowered. Also, it is considered that such coarse γ'-phase grains that prevent the migration of a grain boundary were not sufficiently obtained, the crystal grains were easily allowed to grow in the crystal grain fining forging step S3, and hence a fine alloy structure could not be obtained.

In Comparative Examples 3 and 4, the holding temperature was as low as Ts−10° C. in the overaging thermal treatment step S2 and, as a result, the cases were evaluated as bad for "Average γ' interval" and "Crystal grain size B". It is considered that this is because the fine γ' phase formed by rapid cooling after the blooming forging step S1 did not form a solid solution and was maintained. Therefore, it is also considered that the γ' phase is finely dispersed, the average interval thereamong is narrowed, the migration of dislocation is inhibited, and thus the hot workability is lowered. Also, it is considered that such coarse γ'-phase grains that prevent the migration of a grain boundary are not sufficiently obtained. Accordingly, it is considered that the crystal grains were easily allowed to grow in the crystal grain fining forging step S3 and hence a fine alloy structure could not be obtained. Incidentally, it is considered that since the γ' phase was not allowed to form a solid solution during the holding in the overaging thermal treatment step S2, significant difference could not be observed in Comparative Examples 3 and 4 even when the cooling rate was changed thereafter.

In Comparative Example 5, as described above, the blooming forging step S1 was omitted and, as a result, the case was evaluated as bad for all of "Crystal grain size A", "Average γ' interval", "Hot workability", and "Crystal grain size B". It is considered that this is because a homogeneous alloy structure could not be obtained as a whole since the blooming forging step S1 was omitted. Therefore, it is considered that, even in the overaging thermal treatment step S2, a large amount of the γ' phase was partially contained to form fine γ'-phase grains, the average interval thereamong was narrowed, the migration of dislocation was inhibited, and thus the hot workability was lowered. Moreover, it is considered that such coarse γ'-phase grains that prevent the migration of a grain boundary were not sufficiently obtained, in addition, the crystal grains were originally large in the homogenization thermal treatment before the blooming forging step S1, and thus a fine alloy structure could not be obtained even in the crystal grain fining forging step S3.

As above, alloy materials each having a fine alloy structure could be obtained in Examples 1 to 7 as compared with Comparative Examples 1 to 5. Incidentally, as described above, since each of the alloys used in the present Examples has a relatively low solvus temperature Ts, temperatures for the solid solution thermal treatment and the others can be set relatively low. Thereby, the growth of the crystal grains during and after the blooming forging step S1 can be suppressed as a whole and thus, a fine alloy structure can be obtained to the inside even in the case of a large-sized product.

Incidentally, the composition range of the alloy capable of affording high-temperature strength and hot forgeability almost equal to those of the Ni-based superalloys including Examples described above is determined as follows.

C combines with Cr, Nb, Ti, W, Ta, and the like to form various carbides. Particularly. Nb-based, Ti-based and Ta-based carbides having a high solid solution temperature can suppress, by a pinning effect thereof, crystal grains from coarsening through growth of the crystal grains under high temperature environment. Therefore, these carbides mainly suppress a decrease in toughness, and thus contribute to an improvement in hot forgeability. Also, C precipitates Cr-based, Mo-based, W-based, and other carbides in a grain boundary to strengthen the grain boundary and thereby contributes to an improvement in mechanical strength. On the other hand, in the case where C is added excessively, the carbides are excessively formed and an alloy structure is made uneven due to segregation of the carbides or the like. Also, excessive precipitation of the carbides in the grain boundary leads to a decrease in the hot forgeability and mechanical workability. In consideration of these facts, C is contained, in terms of % by mass, within the range of more than 0.001% and less than 0.100%, and preferably within the range of more than 0.001% and less than 0.06%.

Cr is an indispensable element for densely forming a protective oxide film of $Cr_2O_3$ and Cr improves corrosion resistance and oxidation resistance of the alloy to enhance productivity and also makes it possible to use the alloy for long period of time. Also, Cr combines with C to form a carbide and thereby contributes to an improvement in mechanical strength. On the other hand, Cr is a ferrite stabilizing element, and its excessive addition makes an FCC structure of the Ni matrix unstable to thereby promote generation of a σ phase or a Laves phase, which are embrittlement phases, and cause a decrease in the hot forgeability, mechanical strength and toughness. In consideration of these facts, Cr is contained, in terms of % by mass, within the range of 11% or more and less than 19%, and preferably within the range of 13% or more and less than 19%.

Co improves the hot forgeability by forming a solid solution in the matrix of the Ni-based superalloy and also improves the high-temperature strength. On the other hand, Co is expensive and therefore its excessive addition is disadvantageous in view of cost. In consideration of these facts, Co is contained, in terms of % by mass, within the range of more than 5% and less than 25%, preferably within the range of more than 11% and less than 25%, and further preferably within the range of more than 15% and less than 25%.

Fe is an element unavoidably mixed in the alloy depending on the selection of raw materials at the alloy production, and the raw material cost can be suppressed when raw materials having a large Fe content are selected. On the other hand, an excessive content thereof leads to a decrease in the mechanical strength. In consideration of these facts, Fe is contained, in terms of % by mass, within the range of 0.1% or more and less than 4.0%, and preferably within the range of 0.1% or more and less than 3.0%.

Mo and W are solid solution strengthening elements that form a solid solution in the matrix of the Ni-based superalloy, and distort the crystal lattice to increase the lattice constant. Also, both Mo and W combine with C to form carbides and strengthen the grain boundary, thereby contributing to an improvement in the mechanical strength. On the other hand, their excessive addition promotes generation of a σ phase and a μ phase to lower toughness. In consideration of these facts, Mo is contained, in terms of % by mass, within the range of more than 2.0% and less than 5.0%. Also, W is contained, in terms of % by mass, within the range of more than 1.0% and less than 5.0%.

Nb, Ti and Ta combine with C to form an MC-type carbide having a relatively high solid solution temperature and thereby suppress coarsening of crystal grains after solid solution thermal treatment (pining effect), thus contributing to an improvement in the high-temperature strength and hot forgeability. Also, Nb, Ti and Ta have a large atomic radius as compared with Al, and are substituted on the Al site of the γ' phase ($Ni_3Al$) that is a strengthening phase to form $Ni_3$(Al, Ti, Nb, Ta), thereby distorting the crystal structure to improve the high-temperature strength. On the other hand, their excessive addition raises the solid solution temperature of the γ' phase, forms the γ phase as primary crystals as in the case of a cast alloy, and, as a result, forms eutectic γ' phase to lower the mechanical strength. Furthermore, since each of Nb and Ta has a large specific gravity, specific gravity of the material is increased and, particularly in a large-sized material, a decrease in specific strength is caused. Moreover, Nb may form a γ' phase that transforms into a δ phase that lowers the mechanical strength at 700° C. or higher. In consideration of these facts, Nb is contained, in terms of % by mass, within the range of 0.3% or more and less than 4.0%, preferably within the range of 1.0% or more and less than 3.0%, and more preferably within the range of 2.1% or more and less than 3.0%. Ti is contained, in terms of % by mass, within the range of more than 1.0% and less than 2.5%. Ta is contained, in terms of % by mass, within the range of 0.01% or more and less than 2.0%.

Al is a particularly important element for producing the γ' phase ($Ni_3Al$) that is a strengthening phase to enhance the high-temperature strength, and lowers the solid solution temperature of the γ' phase to improve the hot forgeability. Furthermore, Al combines with O to form a protective oxide film of $Al_2O_3$ and thus improves corrosion resistance and oxidation resistance. Moreover, since Al predominantly produces the γ' phase to consume Nb, the generation of the γ' phase by Nb as described above can be suppressed. On the other hand, its excessive addition raises the solid solution temperature of the γ' phase and excessively precipitates the γ' phase, so that the hot forgeability is lowered. In consideration of these facts, Al is contained, in terms of % by mass, within the range of more than 3.0% Y and less than 5.0%, and preferably within the range of more than 3.0% and less than 4.5%.

B and Zr segregate at a grain boundary to strengthen the grain boundary, thereby contributing to an improvement in the workability and mechanical strength. On the other hand, their excessive addition impairs ductility due to excessive segregation at the grain boundary. In consideration of these facts, B may be contained, in terms of % by mass, within the range of 0.0001% or more and less than 0.03%. Zr may be contained, in terms of % by mass, within the range of 0.0001% or more and less than 0.1%. Incidentally, B and Zr are not essential elements and one or two thereof can be selectively added as arbitrary element(s).

Mg, Ca, and REM (rare earth metal) contribute to an improvement in the hot forgeability of the alloy. Moreover, Mg and Ca can act as a deoxidizing or desulfurizing agent during alloy melting and REM contributes to an improvement in oxidation resistance. On the other hand, their excessive addition rather lowers the hot forgeability due to their concentration at a grain boundary or the like. In consideration of these facts. Mg may be contained, in terms of % by mass, within the range of 0.0001% or more and less than 0.030%. Ca may be contained, in terms of % by mass, within the range of 0.0001% or more and less than 0.030%. REM may be contained, in terms of % by mass, within the range of 0.001% or more and 0.200% or less. Incidentally, Mg, Ca, and REM are not essential elements and one or two or more thereof can be selectively added as arbitrary element(s).

While typical Examples according to the present invention has been described in the above, the present invention is not necessarily limited thereto. One skilled in the art will be able to find various alternative Examples and modified examples without departing from the attached Claims.

The present application is based on Japanese Patent Application No. 2016-230364 filed on Nov. 28, 2016, which contents are incorporated herein by reference.

What is claimed is:

1. A method for producing a precipitation strengthened Ni-based superalloy material having a component composition consisting of, in terms of % by mass:

C: more than 0.001% and less than 0.100%,
Cr: 11% or more and less than 19%,
Co: more than 5% and less than 25%,
Fe: 0.1% or more and less than 4.0%,
Mo: more than 2.0% and less than 5.0%,
W: more than 1.0% and less than 5.0%,
Nb: 0.3% or more and less than 4.0%,
Al: more than 3.0% and less than 5.0%,
Ti: more than 1.0% and less than 2.5%, and
Ta: 0.01% or more and less than 2.0%,
with the balance being unavoidable impurities and Ni,
wherein, when a content of an element M in terms of atomic % is represented by [M], a value of ([Ti]+[Nb]+[Ta])/[Al]×10 is 3.5 or more and less than 6.5, and a value of [Al]+[Ti]+[Nb]+[Ta] is 9.5 or more and less than 13.0,
the method comprising:
a blooming forging step of performing a forging at a temperature range of from a solvus temperature Ts that is a solid solution temperature of the γ' phase to a melting point Tm, and performing an air cooling to form a billet having an average crystal grain size of #1 or more,
an overaging thermal treatment step of heating and holding the billet at a temperature range of from Ts to Ts+50° C. and then slowly cooling it to a temperature Ts' that is Ts or lower so that γ'-phase grains are allowed to precipitate and grow and to increase an average interval thereof, and
a crystal grain fining forging step of performing another forging at a temperature range of from Ts−150° C. to Ts and performing another air cooling,
wherein Ts is from 1,030° C. to 1,100° C., and
wherein crystal growth is suppressed by the γ'-phase grains resulting from the overaging thermal treatment to result in an overall average crystal grain size of #8 or more after the crystal grain fining forging step.

2. The method for producing a precipitation strengthened Ni-based superalloy material according to claim 1,
wherein the average interval of the γ'-phase grains after the overaging thermal treatment is 0.5 μm or more.

3. The method for producing a precipitation strengthened Ni-based superalloy material according to claim 1,
wherein in the overaging thermal treatment step, a cooling rate to Ts' is 20° C./h or less and Ts' is less than Ts−50.

4. A method for producing a precipitation strengthened Ni-based superalloy material having a component composition consisting of, in terms of % by mass:

C: more than 0.001% and less than 0.100%,
Cr: 11% or more and less than 19%,
Co: more than 5% and less than 25%,
Fe: 0.1% or more and less than 4.0%,
Mo: more than 2.00% and less than 5.0%,
W: more than 1.0% and less than 5.0%,
Nb: 0.3% or more and less than 4.0%,
Al: more than 3.0% and less than 5.0%,
Ti: more than 1.0% and less than 2.5%,
Ta: 0.01% or more and less than 2.0%, and
at least one selected from the group consisting of
B: less than 0.03%,
Zr: less than 0.1%,
Mg: less than 0.030%,
Ca: less than 0.030%, and
REM: 0.200% or less,
with the balance being unavoidable impurities and Ni,
wherein, when a content of an element M in terms of atomic % is represented by [M], a value of ([Ti]+[Nb]+[Ta])/[Al]×10 is 3.5 or more and less than 6.5, and a value of [Al]+[Ti]+[Nb]+[Ta] is 9.5 or more and less than 13.0,
the method comprising:
a blooming forging step of performing a forging at a temperature range of from a solvus temperature Ts that is a solid solution temperature of the γ' phase to a melting point Tm, and performing an air cooling to form a billet having an average crystal grain size of #1 or more,
an overaging thermal treatment step of heating and holding the billet at a temperature range of from Ts to Ts+50° C. and then slowly cooling it to a temperature Ts' that is Ts or lower so that γ'-phase grains are allowed to precipitate and grow and to increase an average interval thereof, and a crystal grain fining forging step of performing another forging at a temperature range of from Ts−150° C. to Ts and performing another air cooling, wherein Ts is from 1,030° C. to 1,100° C., and wherein crystal growth is suppressed by the γ'-phase grains resulting from the overaging thermal treatment to result in an overall average crystal grain size of #8 or more after the crystal grain fining forging step.

5. The method for producing a precipitation strengthened Ni-based superalloy material according to claim 4, wherein the average interval of the γ'-phase grains after the overaging thermal treatment is 0.5 μm or more.

6. The method for producing a precipitation strengthened Ni-based superalloy material according to claim 4, wherein in the overaging thermal treatment step, a cooling rate to Ts' is 20° C./h or less and Ts' is less than Ts−50.

7. The method for producing a precipitation strengthened Ni-based superalloy material according to claim 4, wherein the component composition comprises, in terms of % by mass, at least one element selected from the group consisting of:

B: 0.0001% or more and less than 0.03% and

Zr: 0.0001% or more and less than 0.1%.

8. The method for producing a precipitation strengthened Ni-based superalloy material according to claim 4, wherein the component composition comprises, in terms of % by mass, at least one element selected from the group consisting of:

Mg: 0.0001% or more and less than 0.030%,

Ca: 0.0001% or more and less than 0.030% and

REM: 0.001% or more and 0.200% or less.

* * * * *